US010082058B2

(12) United States Patent
Creager et al.

(10) Patent No.: US 10,082,058 B2
(45) Date of Patent: Sep. 25, 2018

(54) MUFFLER WITH SELECTED EXHAUST PATHWAYS

(71) Applicant: Roush Enterprises, Inc., Livonia, MI (US)

(72) Inventors: Christopher W. Creager, Ypsilanti, MI (US); Justin G. Schroeder, South Lyon, MI (US)

(73) Assignee: Roush Enterprises, Inc., Livonia, MI (US)

( * ) Notice: Subject to any disclaimer, the term of this patent is extended or adjusted under 35 U.S.C. 154(b) by 31 days.

(21) Appl. No.: 15/340,476

(22) Filed: Nov. 1, 2016

(65) Prior Publication Data

US 2017/0122155 A1 May 4, 2017

Related U.S. Application Data

(60) Provisional application No. 62/249,529, filed on Nov. 2, 2015.

(51) Int. Cl.

| | |
|---|---|
| ***F01N 1/24*** | (2006.01) |
| ***F01N 1/16*** | (2006.01) |
| ***F01N 9/00*** | (2006.01) |

(52) U.S. Cl.

CPC ..... *F01N 1/166* (2013.01); *F01N 1/165* (2013.01); *F01N 1/168* (2013.01); *F01N 1/24* (2013.01);

(Continued)

(58) Field of Classification Search

CPC ..... F01N 1/166; F01N 1/165; F01N 1/168; F01N 1/24; F01N 9/00

(Continued)

(56) References Cited

U.S. PATENT DOCUMENTS

| | | | | |
|---|---|---|---|---|
| 4,779,705 A | 10/1988 | Verdin | ..... | 181/236 |
| 4,913,260 A | 4/1990 | Fallon | ..... | 181/254 |

(Continued)

FOREIGN PATENT DOCUMENTS

| | | | | |
|---|---|---|---|---|
| DE | 10 2005 029 763 A1 | 12/2006 | ..... | F02D 9/04 |
| DE | 10 2012 200 456 A1 | 7/2013 | ..... | F01N 1/16 |

(Continued)

OTHER PUBLICATIONS

International Searching Authority, International Search Report—International Application No. PCT/US2016/059908, dated Jan. 26, 2017, together with the Written Opinion of the International Searching Authority, 13 pages.

*Primary Examiner* — Forrest M Phillips

(74) *Attorney, Agent, or Firm* — Sunstein Kann Murphy & Timbers LLP

(57) ABSTRACT

The muffler for a motorized vehicle includes a housing with an inlet chamber and an outlet chamber, an exhaust inlet, and an exhaust outlet. The muffler includes a first channel with a first noise dampening amount that is within the housing interior, to fluidly connect the inlet chamber and the outlet chamber. The muffler includes second channel with a second noise dampening amount that is within the housing interior between the inlet chamber and the outlet chamber. The first noise dampening amount is greater than the second noise dampening amount. A valve selectively fluidly connects the inlet chamber and the outlet chamber thorough the second channel, and is configured to variably obstruct the flow of exhaust gas through the second channel. In various embodiments, the muffler has more than one inlet chamber and more than one exhaust outlet.

29 Claims, 9 Drawing Sheets

(52) U.S. Cl.
CPC ..... *F01N 9/00* (2013.01); *F01N 2900/0414* (2013.01); *F01N 2900/08* (2013.01); *F01N 2900/10* (2013.01); *F01N 2900/12* (2013.01)

(58) Field of Classification Search
USPC ..... 181/237, 254
See application file for complete search history.

(56) References Cited

U.S. PATENT DOCUMENTS

| | | | | |
|---|---|---|---|---|
| 5,014,817 | A | 5/1991 | Takato et al. | 181/254 |
| 5,271,224 | A | 12/1993 | Cruickshank | 60/314 |
| 5,388,408 | A | 2/1995 | Lawrence | 60/324 |
| 5,723,829 | A | 3/1998 | Inomata et al. | 181/254 |
| 5,959,263 | A | 9/1999 | Foltz, Jr. | 181/254 |
| 6,102,154 | A | 8/2000 | Liu et al. | 181/265 |
| 6,178,745 | B1 | 1/2001 | Meusen | 60/312 |
| 6,546,722 | B2 | 4/2003 | Sagara et al. | 60/324 |
| 6,584,767 | B1 | 7/2003 | Koenig | 60/288 |
| 6,598,390 | B2 * | 7/2003 | Chang | F01N 1/006 181/227 |
| 6,612,400 | B2 | 9/2003 | Bravo | 181/254 |
| 6,633,646 | B1 | 10/2003 | Hwang | 381/71.5 |
| 6,662,554 | B2 | 12/2003 | Sheidler et al. | 60/290 |
| 6,755,279 | B2 | 6/2004 | Kaneko et al. | 181/232 |
| 6,760,659 | B1 | 7/2004 | Cowen | 701/113 |
| 6,938,729 | B2 | 9/2005 | Wörner et al. | 181/254 |
| 7,040,451 | B2 | 5/2006 | Schumacher et al. | 181/254 |
| 7,337,609 | B2 | 3/2008 | Mahnken et al. | 60/297 |
| 7,347,045 | B2 * | 3/2008 | Bozmoski | F01N 1/166 60/287 |
| 7,380,638 | B2 | 6/2008 | Willey | 181/254 |
| 7,510,051 | B2 | 3/2009 | Schrandt | 181/251 |
| 7,527,126 | B2 | 5/2009 | Kuroda et al. | 181/254 |
| 7,686,130 | B1 * | 3/2010 | Quaglia | F01N 13/087 180/309 |
| 7,703,574 | B2 | 4/2010 | Krüger et al. | 181/254 |
| 8,109,084 | B2 * | 2/2012 | Morita | F01N 13/08 181/249 |
| 8,384,528 | B2 | 2/2013 | McCarthy et al. | 340/384.3 |
| 8,413,428 | B2 | 4/2013 | Devismes | 60/288 |
| 8,469,142 | B2 | 6/2013 | Feng | 181/254 |
| 8,776,504 | B2 | 7/2014 | Kleinfeld | 60/295 |
| 8,857,561 | B2 | 10/2014 | Abram et al. | 181/254 |
| 9,574,471 | B2 * | 2/2017 | Hayama | F01N 1/166 |
| 2002/0010541 | A1 | 1/2002 | Houston et al. | 701/115 |
| 2002/0033303 | A1 * | 3/2002 | Nagai | F01N 1/165 181/237 |
| 2006/0292974 | A1 | 12/2006 | Schorn et al. | 454/63 |
| 2007/0220226 | A1 | 9/2007 | Kirihata | 711/163 |
| 2007/0246295 | A1 | 10/2007 | Aso | 181/256 |
| 2007/0272480 | A1 * | 11/2007 | Kuroda | B01D 53/9454 181/254 |
| 2008/0023264 | A1 | 1/2008 | Pacini et al. | 181/237 |
| 2008/0078613 | A1 * | 4/2008 | Liu | F01N 1/16 181/237 |
| 2008/0245605 | A1 | 10/2008 | Maeda et al. | 181/254 |
| 2009/0211841 | A1 | 8/2009 | Bagheri | 181/241 |
| 2009/0229913 | A1 | 9/2009 | Tonietto et al. | 181/254 |
| 2010/0140014 | A1 * | 6/2010 | Han | F01N 1/084 181/254 |
| 2010/0307864 | A1 | 12/2010 | Bohata | 181/254 |
| 2011/0099989 | A1 | 5/2011 | Prior et al. | 60/320 |
| 2011/0197572 | A1 * | 8/2011 | Chang | F01N 1/166 60/324 |
| 2012/0181106 | A1 | 7/2012 | Nottelman et al. | 181/228 |
| 2013/0186062 | A1 | 7/2013 | Pommerer et al. | 60/273 |
| 2014/0069739 | A1 | 3/2014 | Schorn et al. | 181/228 |
| 2014/0161671 | A1 | 6/2014 | Cuellar et al. | 422/115 |

FOREIGN PATENT DOCUMENTS

| | | | | |
|---|---|---|---|---|
| EP | 1 867 844 | A1 | 12/2007 | F01N 1/16 |
| EP | 2 199 551 | A1 | 6/2010 | F01N 1/16 |
| JP | 9-209739 | A | 8/1997 | F01N 1/02 |
| JP | 2005-325820 | A | 11/2005 | F01N 7/06 |
| WO | WO 2012/030222 | A1 | 3/2012 | F01N 1/16 |
| WO | WO 2013/112101 | A1 | 8/2013 | F01N 13/04 |

* cited by examiner

MUFFLER WITH SELECTED EXHAUST PATHWAYS

RELATED PATENT APPLICATION

This patent application is related to U.S. patent application Ser. No. 14/797,791, filed Jul. 13, 2015, entitled, "EXHAUST CONTROL SYSTEM," and naming Erin M. Dmytrow, Ryan L. Martin, and Justin G. Schroeder as inventors, the disclosure of which is incorporated herein, in its entirety, by reference. This patent application also claims priority to U.S. Provisional Patent Application No. 62/249,529, filed Nov. 2, 2015 and entitled "MUFFLER WITH SELECTED EXHAUST PATHWAYS," the disclosure of which is incorporated herein, in its entirety, by reference.

FIELD OF THE INVENTION

The invention generally relates to exhaust systems of motorized vehicles and, more particularly, the invention relates to controlling the sound of the exhaust systems.

BACKGROUND OF THE INVENTION

Motorized vehicles, such as automobiles, have exhaust systems to guide exhaust gases away from the controlled combustion taking place inside their engines. In addition to exhausting gases, exhaust systems also control engine noise. Specifically, much of the engine noise produced by the internal combustion process emanates through the exhaust system. In fact, that noise can be quite loud and, consequently, disturbing to the driver and people near the driver. Exhaust systems therefore typically have a muffler to reduce the engine noise, and the muffler is often configured to mitigate the noise to levels defined by state and local noise regulations.

Sports car and sport truck enthusiasts, however, may prefer to hear the full sound of their engines. For example, sports car enthusiasts often prefer to hear the "rumble" of their engines when riding their sports cars on a closed track. Indeed, the muffler function often is not legally necessary on a track in this instance since tracks generally are not subject to the municipal noise regulations. Some tracks, however, are subject to noise regulations and thus, also still must be muffled to some extent to comply with the noise regulations.

SUMMARY OF VARIOUS EMBODIMENTS

A first embodiment of the invention is a muffler for a motorized vehicle. The muffler includes a housing forming a housing interior having an inlet chamber and an outlet chamber, an exhaust inlet for receiving exhaust gas in the inlet chamber, and an exhaust outlet for directing exhaust gas from the outlet chamber. The muffler also includes a first channel within the housing interior to fluidly connect the inlet chamber and the outlet chamber. The first channel has a first noise dampening amount. The muffler includes second channel within the housing interior between the inlet chamber and the outlet chamber. The second channel has a second noise dampening amount, and the first noise dampening amount is greater than the second noise dampening amount. The muffler also includes a valve within the housing interior. The valve selectively fluidly connecting the inlet chamber and the outlet chamber thorough the second channel. It is further configured to variably obstruct the flow of exhaust gas through the second channel.

The muffler may also include a controller that is operatively coupled with the valve and configured to control the position of the valve. The controller is within the housing interior. The muffler may also include a motor within the housing interior, and the motor is configured to move the position of the valve in response to a signal from the controller. The valve may include a disk positioned within the second channel, and the disk may be configured to rotate about an axis to variably obstruct the flow of exhaust gas through the second channel.

In some embodiments, the exterior surface of the housing includes a top housing surface forming a recessed region. A motor that is configured to control the position of the valve may be positioned within the recessed region of the housing. The motor may include a top motor surface that is substantially flush with or below the top housing surface. The muffler may also include a third channel with noise damping material that connects the inlet chamber and the outlet chamber. The controller may be configured to receive a signal, from a user interface, corresponding to a level of obstruction selected by a user and control the position of the valve based on the signal. In some embodiments, the level of obstruction for the second channel may be a predefined level, and in other embodiments, the level of obstruction for the second channel may be based on dynamic parameters of the motorized vehicle. The dynamic parameters may include a throttle position of the motorized vehicle, a speed of the motorized vehicle, a load on the motorized vehicle engine, RPM of the engine, gear of a transmission system of the motorized vehicle, a position of the motorized vehicle in its environment, a local time, or any combination thereof.

A second embodiment of the invention is a method of controlling the sound of a muffler system for a motorized vehicle. The method includes flowing exhaust gas through a first channel inside a housing of a muffler. The first channel is configured to dampen exhaust noise and connect an inlet chamber of the housing and an outlet chamber of the housing. A second channel is inside the housing between the inlet chamber and the outlet chamber and configured to selectively receive exhaust gas from the inlet chamber of the housing. The method includes receiving, from a user interface outside of the housing, a signal corresponding to a selected level of obstruction for the second channel. The method includes controlling, based on the received signal, a position of a valve within the housing to vary the exhaust gas flow resistance through the second channel. The valve selectively fluidly connects the inlet chamber with the outlet chamber through the second channel.

In some embodiments, controlling the position of the valve includes determining, by a controller operatively coupled to the user interface, the position of the valve. Controlling the position of the valve may include operating a motor coupled to the valve to move the position of the valve and/or rotating a disk, positioned within the second channel, about an axis. Controlling the position of the valve may include determining a predefined position of the valve based on the selected level of obstruction for the second channel, or determining the position of the valve based on dynamic parameters of the motorized vehicle. The dynamic parameters may include a throttle position of the motorized vehicle, a speed of the motorized vehicle, a load on the motorized vehicle engine, RPM of the engine, gear of a transmission system of the motorized vehicle, a position of the motorized vehicle in its environment, a local time, or any combination thereof.

A third embodiment of the invention is a muffler for a motorized vehicle. The muffler includes a housing forming a housing interior having an inlet chamber, an exhaust inlet for receiving exhaust gas in the inlet chamber, a first exhaust outlet, and a second exhaust outlet. The muffler also includes a first channel with noise damping material that is within the housing interior, fluidly connecting the inlet chamber with the first exhaust outlet. The muffler also includes a second channel within the housing interior. The muffler also includes a valve within the housing interior configured to variably obstruct the flow of exhaust gas through the second channel. The valve selectively fluidly connecting the inlet chamber and second exhaust outlet through the second channel. The valve may be within the second channel or outside of the second channel. The muffler may include any of the other features described herein.

Illustrative embodiments of the invention are implemented as a computer program product having a computer usable medium with computer readable program code thereon. The computer readable code may be read and utilized by a computer system, including mobile devices, such as mobile telephones, smartphones, tablets, smartwatches, etc., in accordance with conventional processes.

BRIEF DESCRIPTION OF THE DRAWINGS

Those skilled in the art should more fully appreciate advantages of various embodiments of the invention from the following "Description of Illustrative Embodiments," discussed with reference to the drawings summarized immediately below.

DESCRIPTION OF ILLUSTRATIVE EMBODIMENTS

Some drivers prefer to have control of the noise level and sound of their motorized vehicles. For example, drivers of high performance sports cars, such as the popular Ford Mustang™ (distributed by Ford Motor Company), may prefer to hear the "rumble" of the engine when they rapidly accelerate. To that end, illustrative embodiments described herein depict an automobile or other motorized vehicle that has controls for enabling a user to easily alter the sound of the vehicle. In particular, the vehicle has a muffler with noise dampening and non-noise dampening channels and a controller coupled to a valve for selectively re-directing the flow of exhaust gas from the engine through these channels.

Figure 1:
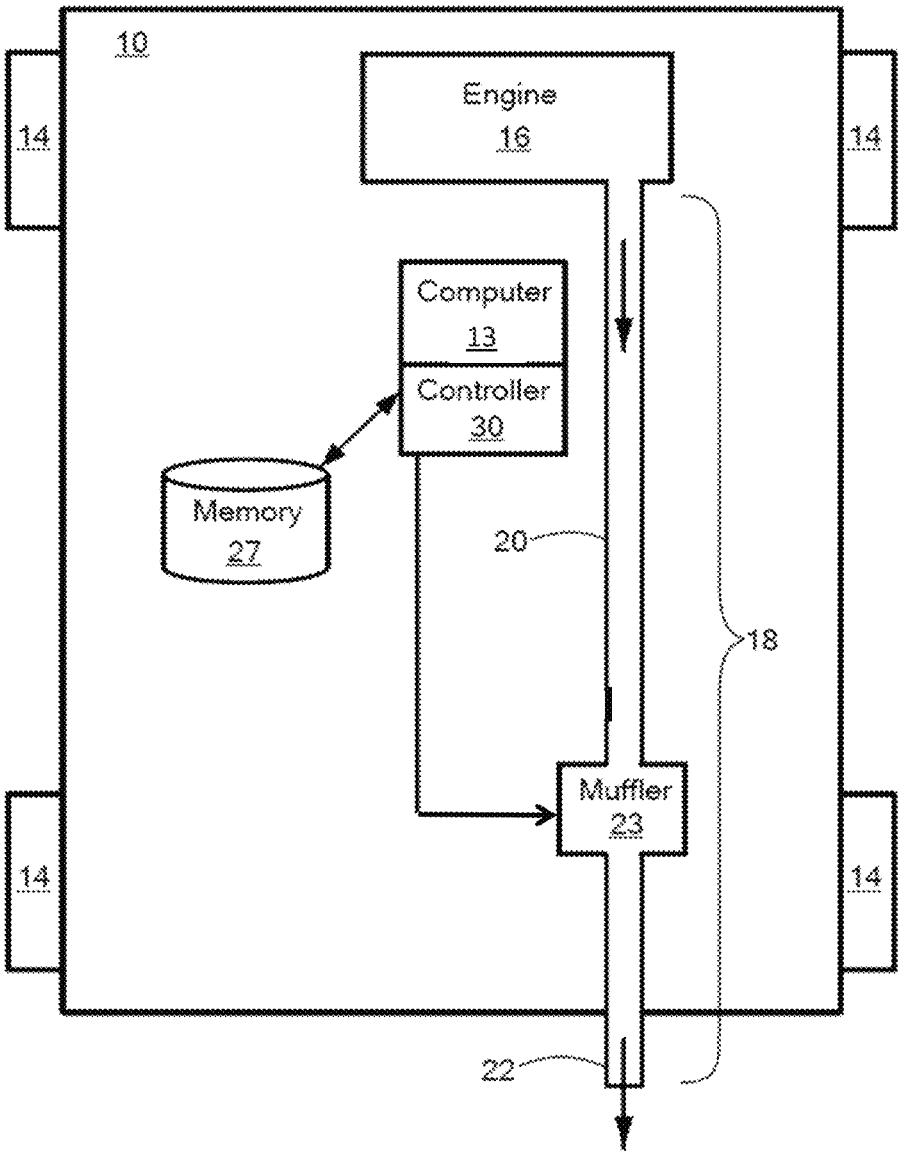
FIG. 1 schematically shows a motorized vehicle configured with a muffler, according to an illustrative embodiment of the invention.

FIG. 1 schematically shows a motorized vehicle configured with a muffler, according to an illustrative embodiment of the invention. In this case, the vehicle is an automobile and identified by reference number 10. Like many other modern automobiles, the automobile 10 shown in FIG. 1 has a body 10 that supports a number of important components, such as, among other things, four wheels 14, an engine 16 for power (e.g., an internal combustion engine powered by gasoline, alternative fuel, or diesel), and an exhaust system 18 for expelling exhaust gas produced by the combustion process of the engine 16.

As shown, the exhaust system 18 generally has a main pipe 20 terminating at a tail pipe 22 that is exposed to the environment. As known by those in the art, much of the noise produced by the engine 16 generally is transmitted to the external environment through the exhaust system 18. Accordingly, the main pipe 20 also has a muffler 23 configured to at least partially mitigate the noise of the exhaust gas.

The automobile 10 also has a central computer 13 that controls many automobile systems, such as, among other things, the safety system (e.g., traction control and airbag safety), emission control, the ignition system, and the general operation of the automobile 10. Indeed, mention of these computer functions is merely illustrative of but a few of the many different functions performed by the central computer 13. Accordingly, discussion of such functions is for descriptive purposes only and not intended to limit various embodiments of the invention. Those skilled in the art understand the many functions of the central computer 13.

Moreover, the central computer 13 is coupled to a controller 30 configured to control a position of a valve 21 in the muffler 23. As explained below, the position of this valve 21 determines the flow of exhaust gas through the channels of the muffler 23 and consequently, the level of noise for the engine sound. Although FIG. 1 depicts the controller 30 as external to the muffler 23, in some embodiments, the controller 30 may be inside the housing of the muffler 23. The automobile 10 also has memory 27 for storing various parameters regarding control of the valve position. In some embodiments, the memory may include read/write memory, and/or read-only memory.

Figure 2:
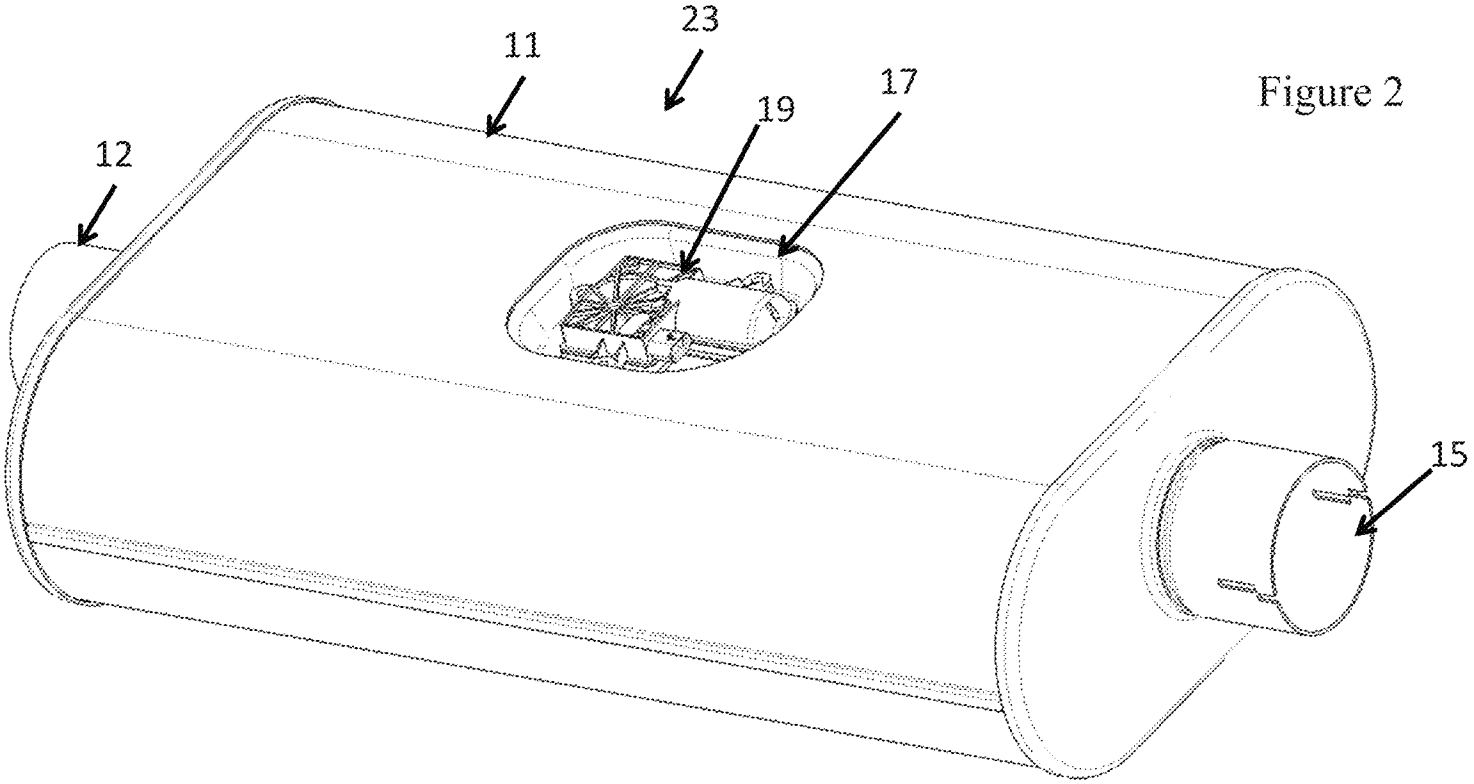
FIG. 2 schematically shows a perspective view of a muffler configured in accordance with illustrative embodiments of the invention.

FIG. 2 schematically shows a perspective view of a muffler 23 configured in accordance with illustrative embodiments of the invention. Because conventional engines generate exhaust gas at high temperatures, conventional mufflers house, at most, one chamber configured to muffle the noise of the gas. The form factor of the single chamber, as well as its materials, enable the chamber to withstand the temperature of the exhaust gas while maintaining its structural integrity.

Thus, unlike the conventional mufflers known to the inventors, an exemplary muffler 23 of the invention has a housing 11 whose interior includes a plurality of internal chambers that direct exhaust gas from an inlet tube 12 toward an outlet tube 15. Also unlike other conventional mufflers known to the inventors, the housing 11 has a top surface that forms an exterior recessed region 17 configured to contain a valve motor 19, which controls the position of a valve 21 within the housing 11 to selectively vary the output sound of the muffler 23. Some embodiments may have the same functionality without the recessed region 17.

Figure 3:
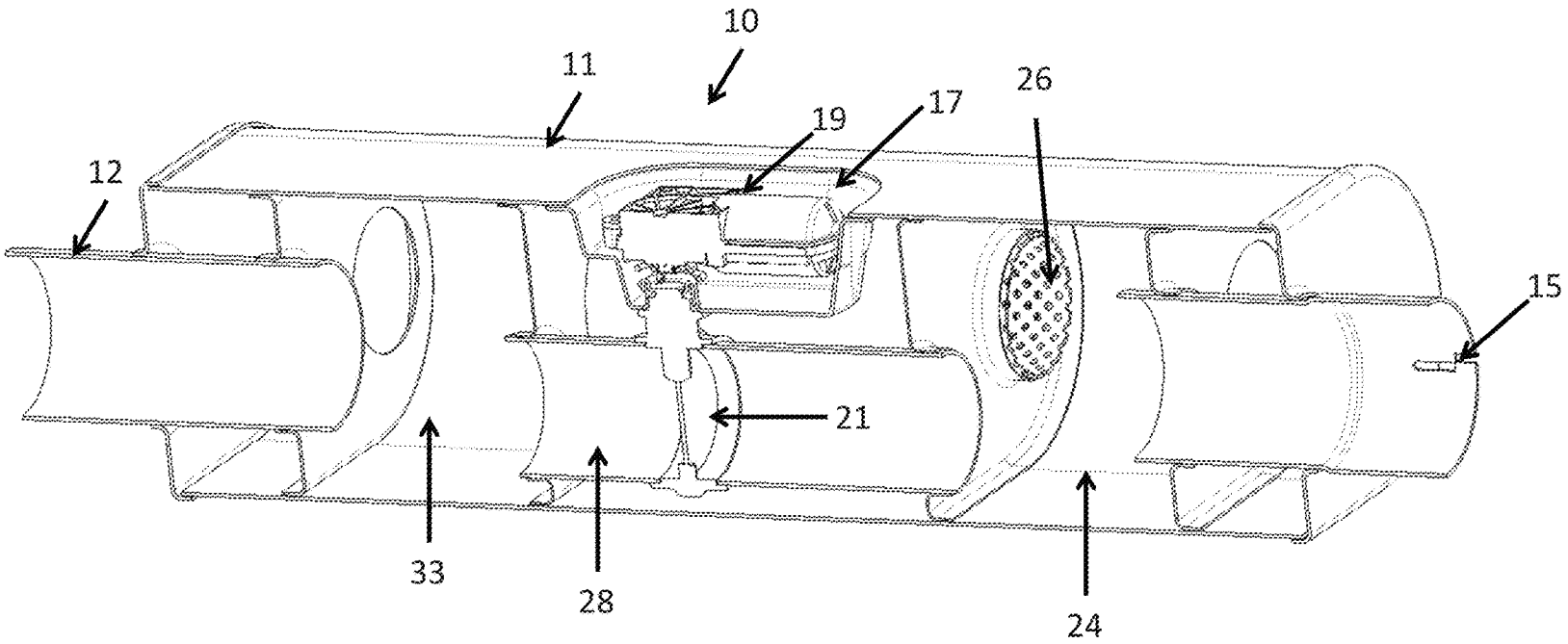
FIG. 3 schematically shows a side cross-sectional view of the muffler of FIG. 2.
Figure 4:
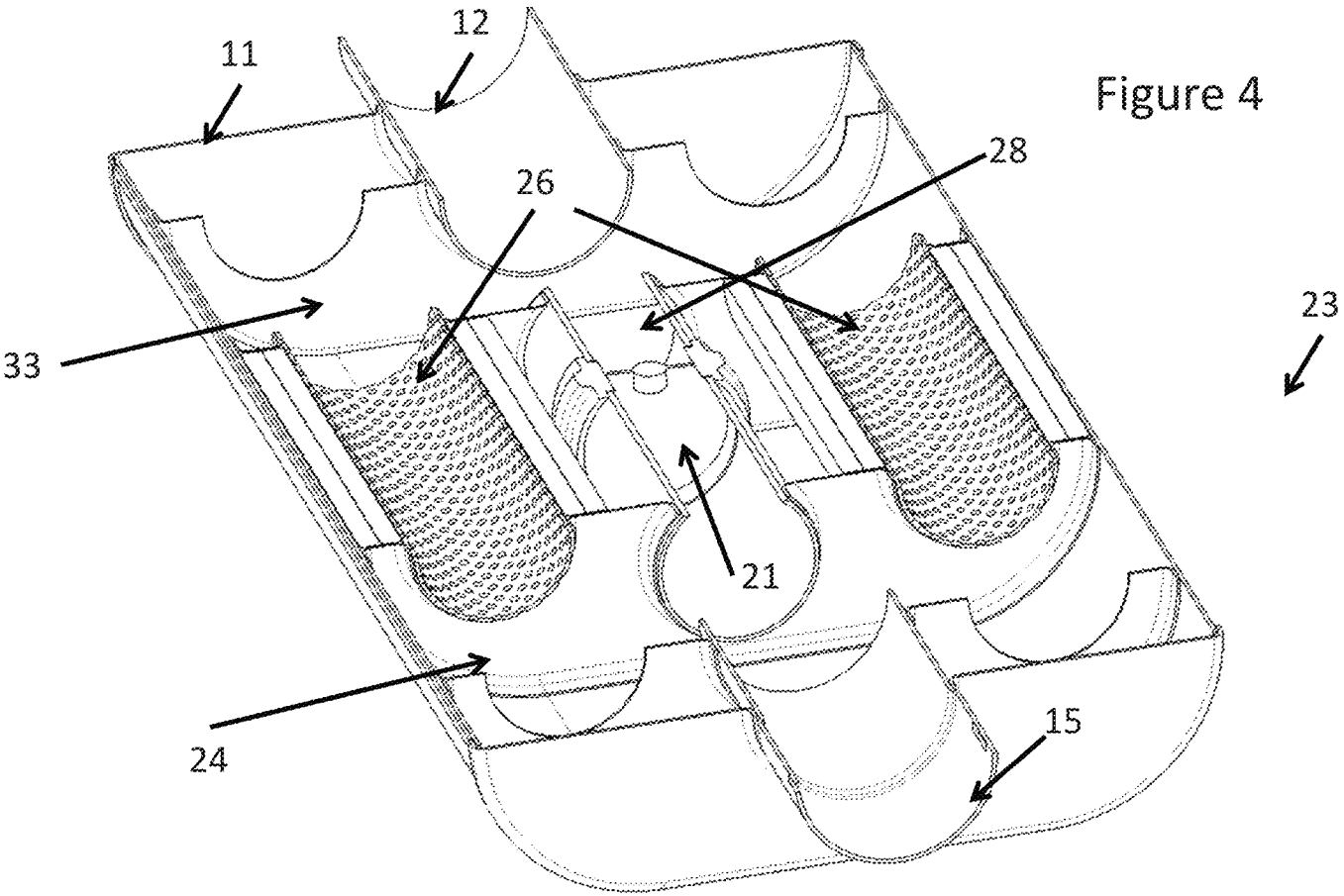
FIG. 4 schematically shows a top cross-sectional view of the muffler of FIG. 2.
Figure 5:
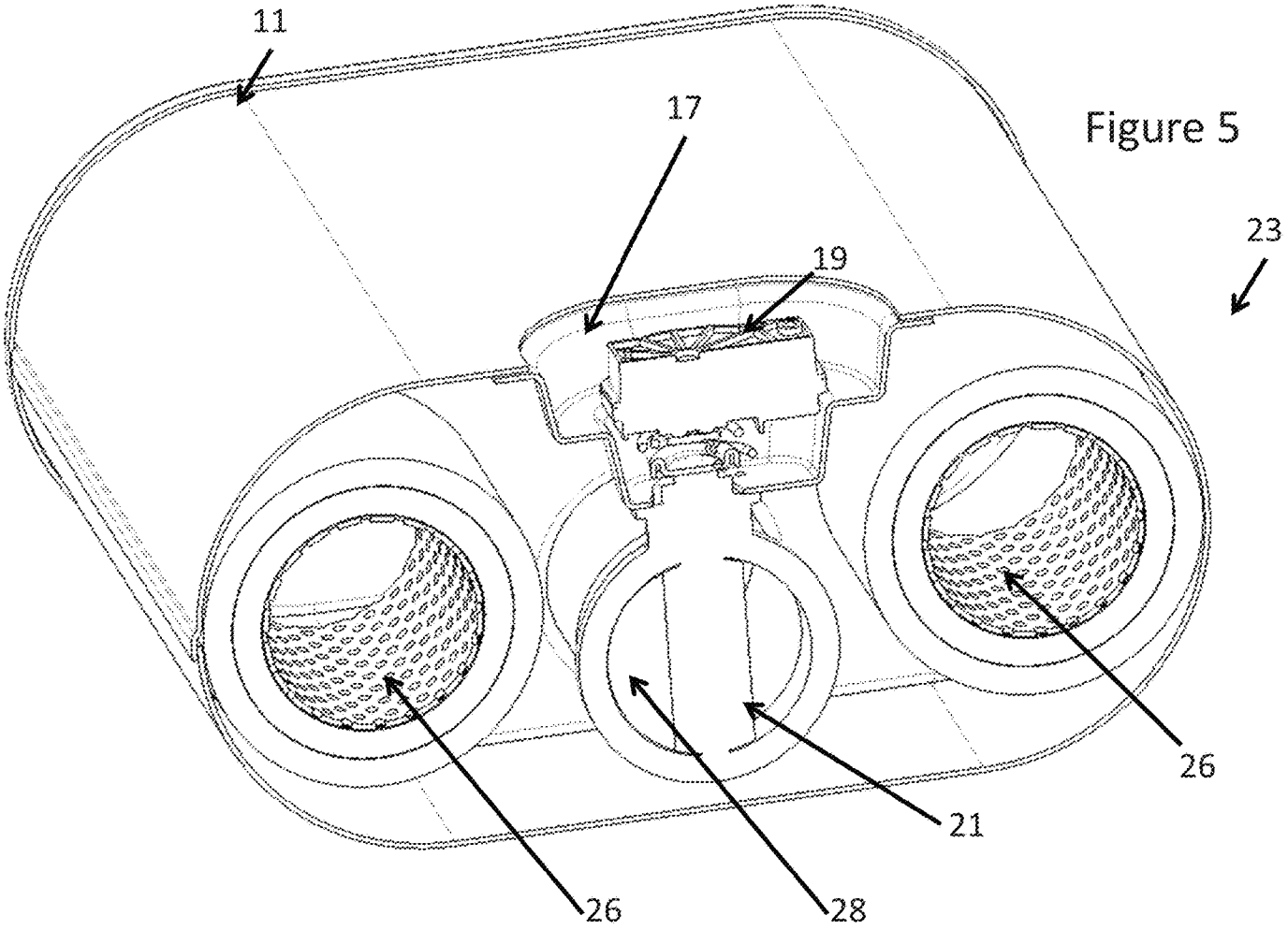
FIG. 5 schematically shows yet another cross-sectional view of the muffler FIG. 2.

FIGS. 3-5 schematically show various cross-sectional views of the muffler 23 of FIG. 2. As best shown by FIGS.

3 and 4, the housing 11 receives the inlet tube 12, coupled to the main pipe 20 of the motorized vehicle 10, that feeds exhaust gas into the housing interior. In this embodiment, the inlet tube 12 terminates within an inlet mixing chamber 33 that fluidly connects to three separate, parallel channels. Each channel may include a tube that fluidly connects the inlet mixing chamber 33 and the outlet mixing chamber 24 by extending from the former 33 and terminating at the latter 24. Accordingly, each of the three parallel channels may have an inlet exposed to the inlet mixing chamber 33 and an outlet exposed to the outlet mixing chamber 24. The outlet mixing chamber 24 also fluidly couples with an inlet of the outlet tube 15, which may be coupled to or correspond to the tail pipe 22 of the motorized vehicle 10. The outlet tube 15 expels exhaust gas from the muffler 23.

Although the embodiment of FIGS. 3 and 4 depicts an outlet mixing chamber 24 that connects to all of the parallel channels, in some embodiments, this chamber 24 may be absent. Instead, each channel may include a separate outlet tube 15 that expels its own flowing exhaust gas.

Moreover, the parallel muffler channels may have different noise dampening amounts, e.g., each channel has noise dampening material that may dampen the noise of exhaust gas flowing through itself by a different amount. In some embodiments, the amount may be represented by a percentage (e.g., 0%, 50%, 90%), and in other embodiments, the amount may be represented by a decibel level (e.g., 0 dB, 15 dB, 20 dB, 30 dB). When a channel has a noise dampening amount that is zero or close to zero, the channel allows exhaust gas to flow through uninhibited and either does not dampen its noise, or dampens the noise by a negligible amount. However, when a channel has a higher noise dampening amount, the channel muffles at least part of the noise of the flowing exhaust gas via a noise dampening material, or other means described herein.

FIG. 4 depicts an exemplary embodiment of a muffler 23 with three parallel channels with different noise dampening amounts. Because the two parallel tubes 26 dampen the noise of flowing exhaust gas, these tubes are referred to herein as "damping channels 26." The dampening channels 26 are open, since their passageways remain unobstructed to allow exhaust gas to flow freely through. Additionally, the dampening channels 26 have high noise dampening amounts. In particular, the dampening channels 26 include noise damping material to reduce the sound of exhaust gas. In some embodiments, the dampening channels 26 may be implemented as perforated metal tubes wrapped in a woven sound damping material. Alternatively, the sound dampening material may line the interiors of the dampening channels 26. Such material may permit exhaust to flow through, but obstruct the gas enough to further dampen its noise.

In contrast, the third of the three parallel channels, the bypass channel 28, allows exhaust gas to flow through without any substantially mitigation of its noise. The bypass channel has no or minimal noise damping material within its interior or along its interior walls.

Under direction by the valve motor 19 and valve controller 30, the valve 21 controls the proportion of exhaust gas flowing through each of the dampening channels 26 and bypass channel 28. The valve 21 may be positioned at any location within the interior of the bypass channel 28. The embodiments of FIGS. 3-5 depict the valve 21 between the inlet and the outlet of the bypass channel 28. However, other embodiments may position the valve 21 in other locations, such as at the inlet or at the outlet of the bypass channel 28.

The valve 21 is configured to variably obstruct the flow of exhaust gas through the bypass channel 28. Exhaust entering the inlet mixing chamber 33 can enter the outlet mixing chamber 24 through the three parallel channels. The position of the valve 21, however, controls the volume of exhaust passing through the damping channels 26 and the bypass channel 28.

When the valve 21 is open, the valve 21 allows exhaust gas to freely pass through the bypass channel 28. As a result, a maximum amount of exhaust gas may pass through the bypass channel 28. In this state, some amount of exhaust still is expected to pass through the damping channels 26. As such, the muffler 23 thus provides minimum noise damping function because the maximum amount of exhaust gas is directed through the bypass channel 28, which has little or no damping function.

When the valve 21 is closed or fully obstructs the bypass channel 28, a maximum amount of exhaust gas is diverted to the dampening channels 26 to the outlet mixing chamber 24. In the state, the muffler 23 thus preferably provides its maximum noise damping function because the maximum amount of exhaust is directed toward and through the damping channels 26.

The valve 21 may also assume any intermediate, partially open position, further altering the proportion of exhaust gas flowing through the three channels 26, 28 and the resulting amount of engine noise. During testing, the inventors discovered that the position of the valve does not have a linear relationship with the range of sounds and noise levels, i.e., the amount of exhaust gas permitted to flow through the bypass channel 28 does not necessarily correspond to a precise, linear change in the noise and sound level.

In some embodiments, the valve 21 includes a simple movable disk (or plate), or other structure. In the embodiment of FIGS. 3-5, the valve 21 may rotate about an axis that bisects the disk. The disk obstructs the flow of exhaust gases through the bypass channel 28 as a function of its orientation about this axis.

For example, when the disk is oriented so its edge is generally along the axis of the bypass channel 28, the bypass channel 28 may be substantially open, thereby allowing a maximum amount of exhaust gas to flow through.

Alternatively, when the disk is in the position shown in FIGS. 3-5, the bypass channel 28 may be substantially closed because the face of the disk is substantially normal to the axis of the bypass channel 28. In some embodiments, the outer perimeter of the disk may form a seal against the inner wall of the bypass channel 28, and embodiments of the disk and bypass channel 28 may include flexible, elastomeric material to make the sealing connection.

Alternative embodiments may permit some amount of exhaust gas to flow through the bypass channel 28. The valve 21 may be configured to selectively block no more than a maximum amount of the bypass channel 28. For example, the valve 21 may include a disk with perforations, or cut-out geometric shapes. Thus, even when the face of the disk is substantially normal to the axis of the bypass channel 28, the perforations or cut-outs prevent the disk from sealing the bypass channel 28. Instead, the disk acts as an obstruction. In some embodiments, the valve 21 may effectively obstruct 90% or less of the bypass channel 28 when in the valve 21 is in maximum obstructing position, though the percentage may vary based on the configuration of the valve 21.

Any of a wide variety of motors may be used to control the position of the valve 21. In some embodiments, the motor 19 is a brushless electric direct current (DC) motor controlled by various inputs, such as logic from the motorized vehicle 10. Furthermore, the motorized vehicle 10 may be equipped with a user interface that enables a user to control the amount of engine noise released, and the computer 13 may interpret signals from the user interface to operate the valve controller 30 and, by extension, the motor 19 and position of the valve 21.

Figure 6:
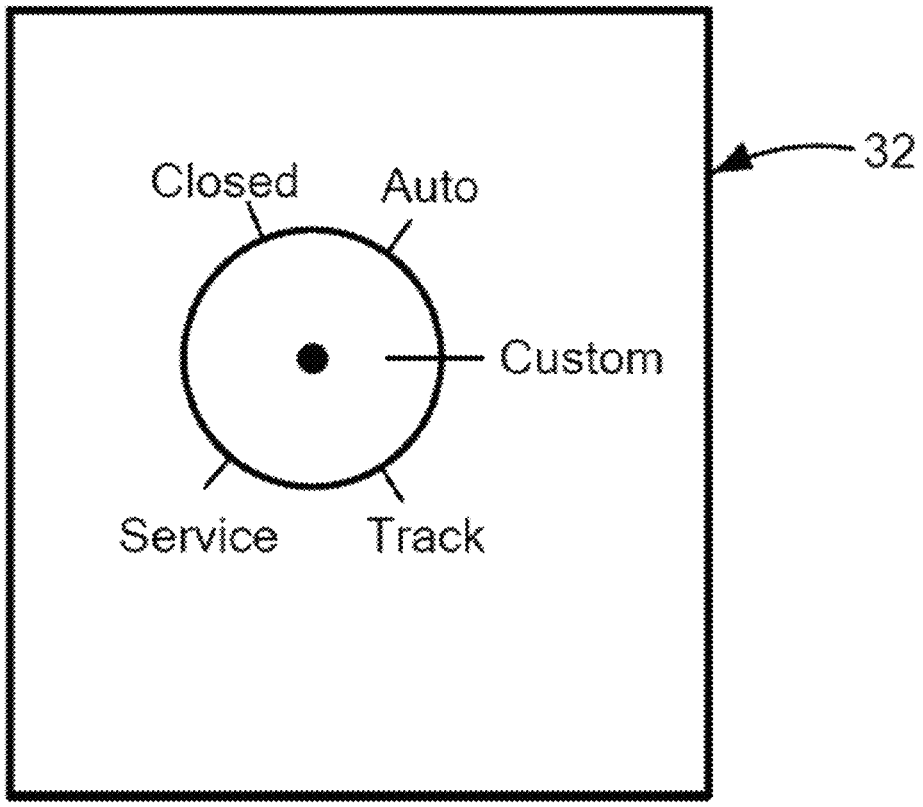
FIG. 6 schematically shows a user interface that a user may manipulate to implement illustrative embodiments of the invention.

For example, the user may move a switch within the automobile, which causes the valve 21 to move in a prescribed manner in a variety of modes. See, for example, incorporated U.S. patent application Ser. No. 14/797,791 for additional examples of such logic, hardware, and software components. FIG. 6 schematically shows a virtual or mechanical switch (e.g., a picture of such a switch 32 on an LCD touch-display screen, or a physical rotatable dial switch 32) that permits the user, while inside the motorized vehicle 10, to change between these modes.

In illustrative embodiments, those modes may include:

Closed Mode: the valve 21 substantially completely closes the bypass channel 28. Accordingly, exhaust gas passes through the dampening channels 26 of the muffler 23 to the tail pipe 22.

Auto Mode: The valve 21 is dynamically opened, closed, or partially open depending on pre-configured parameters. These parameters may be pre-configured by a third party provider, such as an aftermarket dealer or technician. Data controlling movement and position of the valve 21 is only accessible and modifiable by a provider of this equipment to the user. The user, in the role of the user, cannot change that data.

Custom Mode: The valve 21 is dynamically opened, closed, or partially open depending on pre-configured parameters. Unlike in the Auto Mode, however, the parameters may be pre-configured by the user.

Track Mode: The valve 21 is substantially completely open, permitting maximum exhaust gas through the bypass channel 28. In this mode, the motorized vehicle 10 is likely to be at its loudest. This mode is called the "Track Mode" because it is likely to be used commonly when the motorized vehicle 10 is driven on an auto track.

Service Mode: The valve 21 is in a position required by some servicing protocol to service the system.

Various embodiments may use any of a variety of mechanical devices for switching between modes. Some embodiments may use pushbuttons for different modes similar to preselect buttons of a car radio. Those skilled in the art can select any of a variety of other mechanical or virtual switches. Rather than using the above noted switch 32 or other manual or mechanical device, such as that in FIG. 6, the system may be configured with voice recognition technology to change modes upon receipt of a voice command. The user also can control the system with voice-based system override commands. Accordingly, discussion of the switch 32 is illustrative of one embodiment, but not intended to limit various other embodiments.

Moreover, as shown in FIG. 2, when the motor 19 is mounted in the exterior recessed region 17, the top surface of the motor 19 is substantially flush with or below the top housing surface of the muffler 23. Because the motor 19 does not protrude from the housing 11 of the muffler 23, the muffler 23 can be mounted within conventional spaces of the underside of a motorized vehicle 10. The exterior recessed region 17, for example, allows the motor 19 to be assembled after a "cartridge-style" sub-assembly is inserted into the housing 11 of the muffler 23. The recess then may be affixed (e.g., welded) to the housing 11 of the muffler 23. The motor 19 then can be assembled over weld-studs attached to the exterior recessed region 17.

By offsetting the longitudinal axis of the bypass channel 28 toward the outside of the housing 11 (discussed below), the motor 19 is can be "flush" to or below the housing 11. This configuration delivers a unique appearance, enhanced packaging capability, and design flexibility to achieve desired volume and sound quality outputs.

Discussion of the motor 19 being mounted in this manner is but one of a variety of examples. Other embodiments may position the motor 19 at another location, such as at a location that causes the motor 19 to add to the overall profile of the muffler 23.

Other Embodiments

FIGS. 3-5 depict the bypass channel 28 positioned between the two damping channels 26. The bypass channel 28 may be substantially coaxial or "in-line" with the inlet tube 12 and the outlet tube 15. In some embodiments, the bypass channel 28 may be offset from the inlet and outlet tubes 12 and 15. For example, mounting considerations for the motor 19 may force the bypass channel 28 to be downwardly offset relative to the inlet and outlet tubes 12 and 15 (from the perspective of FIG. 3).

In alternative embodiments, the bypass channel 28 is not positioned between the damping channels 26. Other embodiments may use only one damping channel 26, or three or more damping channels 26. In yet other embodiments, the muffler 23 may have more than one bypass channel 28. Those skilled in the art can select the appropriate number of bypass channels 28 and damping channels 26 for a given application.

In some embodiments, from a user interface of the motorized vehicle, a user can select between at least two modes of operation: a static mode that controls exhaust flow direction independently of dynamic parameters of the vehicle, or a dynamic mode that controls exhaust flow direction as a function of the dynamic parameters of the vehicle. Among other things, the dynamic parameters may include the accelerator pedal (also referred to as the "throttle position") and/or speed of the vehicle.

The Custom Mode and Auto Mode described above are considered to be "dynamic modes" because, when the valve controller 30 is in one of those modes, the controller 30 controls movement of the valve 21 about a plurality of positions as a function of at least one dynamic parameter (e.g., accelerator pedal position, speed, and/or other parameters discussed herein). In contrast, the Track Mode and Closed Mode are considered to be "static modes" because, when the valve controller 30 is in one of those modes, the controller 30 sets the valve 21 to a prescribed position independent of any dynamic parameter of the motorized vehicle 10. In other words, when the user selects a static mode, the valve 21 is set to a prescribed position that does not change in response to speed changes, throttle position changes, etc. Although not discussed above, other static modes may position the valve 21 in a partly open/closed position.

In some embodiments, the user can change underlying valve positional data in any of a variety of manners. For example, the user may enter the values of certain parameters and how much the valve 21 should be open during those times. For example, the user may program the valve controller 30 to open the valve 21 about 40 percent (of the full amount it can be opened) when it detects an automobile speed of 35 miles per hour. As another example, the user may program the valve controller 30 to open the valve 21 about 70 percent when it detects that the throttle is depressed 90 percent of its potential range.

Other embodiments may not be so simple. In particular, such embodiments may program the valve controller 30 to set the valve 21 to a specified position in response to receipt of two or more input parameters. This valve opening amount can be based on any of a variety of techniques, such as a simple look-up-table, or a formula that weights or does not weight the parameters. Among other things, illustrative embodiments may control valve position based on individual or combinations of any of the following parameters:

Speed,

Throttle position,

Engine load (i.e., how hard the engine 16 is working, such as whether it is forcing the car up a steep hill), Revolutions per minute (RPM) of the engine 16, Gear of the transmission system, Environmental temperature, Position via global positioning systems (e.g., close the valve 21 when in a residential neighborhood, but open the valve 21 when in a rural area), Level of fuel in the vehicle 10, The local time where the vehicle 10 is operating, and Weather (e.g., if raining, sunny, windy, etc.).

Since some of these parameters may change while the motorized vehicle 10 is moving, such parameters are referred to as "dynamic variables." Moreover, it should be noted that this list is illustrative and not intended to be an exhaustive list of dynamic variables. Accordingly, those skilled in the art may use other dynamic variables to control output sound.

The valve controller 30 receives input parameters from the central computer 13 (or other data source) and responsively controls the amount/pressure of exhaust gas that the valve 21 permits through the bypass channel 28. Those skilled in the art may use any of a variety of conventional technologies to implement the valve controller 30. For example, a conventional engine/electronic control module ("ECM," sometimes part of a larger engine/electronic control unit or "ECU") may be programmed to control the position of the valve 28. Other embodiments may use one or more microprocessors, digital signal processors, and/or other electronics to implement that valve controller 30.

Figure 7:
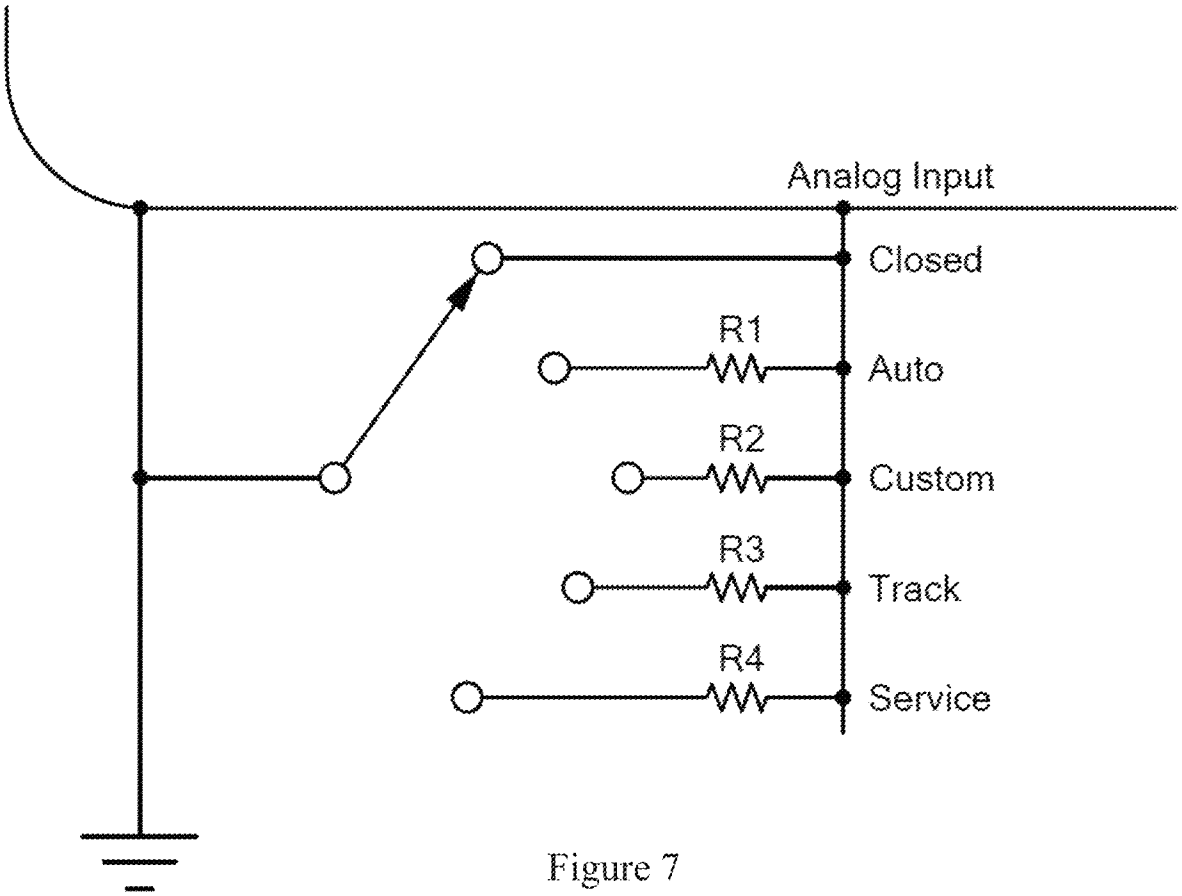
FIG. 7 schematically shows a high-level circuit diagram of the switch of FIG. 6.

FIG. 7 schematically shows a simplified circuit diagram of the switch 32 of FIG. 6, and some positions it can have relative to the noted modes. The resistors are selected to draw different currents toward the valve controller 30. For example, the resistor with the Auto Mode may be 250 ohms, the resistor for the Track Mode may be 750 ohms, and the resistor for the Custom Mode can be 10 kilo-ohms. The valve controller 30 detects the current drawn, which is based on the resistor value, to determine the appropriate mode of operation.

Figure 8:
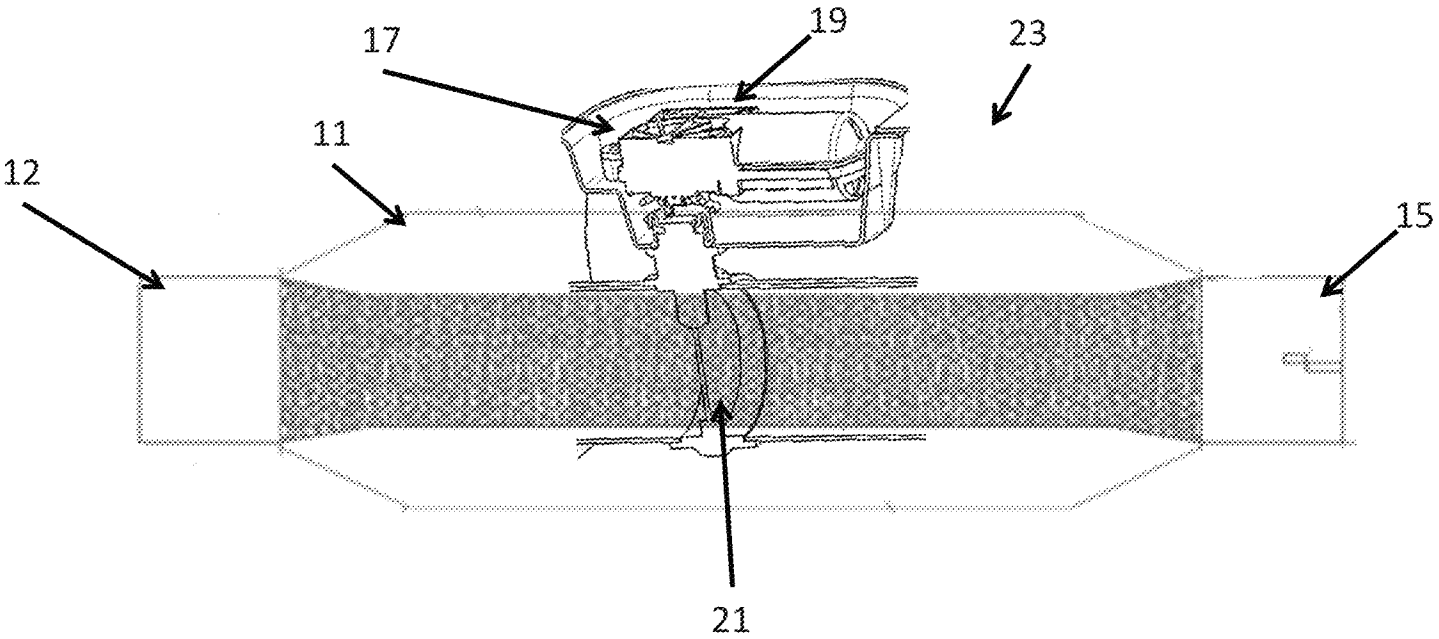
FIG. 8 schematically shows a cross-sectional view of a muffler configured in accordance with other embodiments of the invention.

FIG. 8 schematically shows another embodiment, which uses a standard "bullet" muffler configuration. Specifically, this embodiment has a perforated tube wrapped in woven sound damping material with the valve 21 controlling exhaust gas flow through its interior. In this embodiment, the valve 21 can be used to modulate or divert the flow of exhaust gas from the direct path to the damping material through the perforated tube. In this and other embodiments, the valve 21 can also be designed with a specially sized orifice to regulate back pressure peaks by establishing a pressure-bleed opening. In such case, the valve 21 may function similar to a washer.

In alternative embodiments, instead of or in addition to being within the bypass channel 28, the valve 21 can be positioned to open and close chambers within the muffler 23. This alternative embodiment affects noise, back pressure, and drone.

Figure 9:
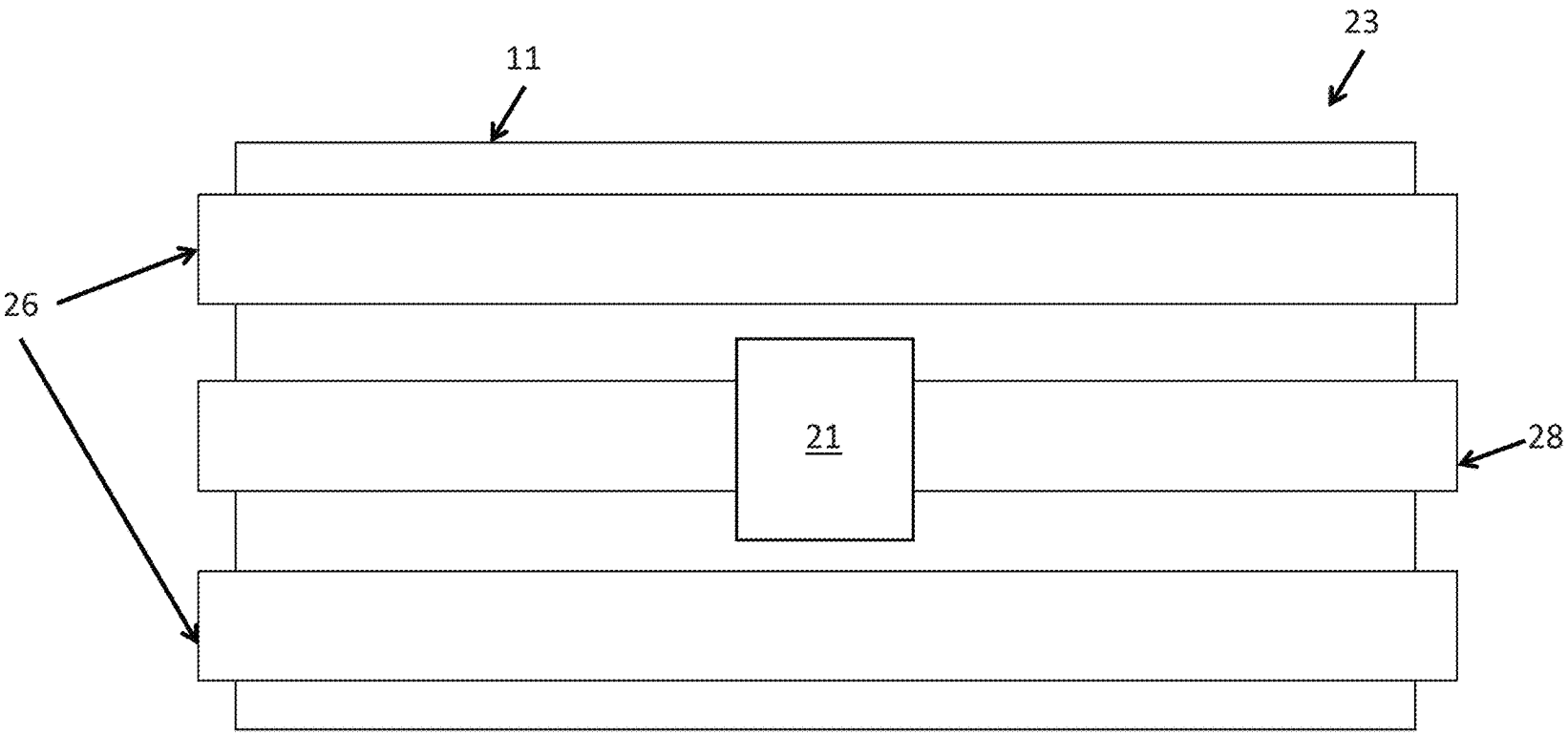
FIG. 9 schematically shows a top cross-sectional view of an exemplary muffler whose channels extend directly out of the muffler.

Although the embodiments described herein depict mufflers 23 whose channels 26, 28 fluidly connect to an inlet mixing chamber 33 and an outlet mixing chamber 24, in some embodiments, the muffler 23 may omit the chambers 33, 24. Such an embodiment is depicted in FIG. 9. The dampening channels 26 and bypass channel 28 extend throughout the length of the housing 11 of the muffler 23. Thus, the channels 26, 28 themselves form the inlets and outlets of the muffler 23.

Although the above discussion discloses various exemplary embodiments of the invention, it should be apparent that those skilled in the art can make various modifications that will achieve some of the advantages of the invention without departing from the true scope of the invention.

What is claimed is:

1. A muffler for a motorized vehicle, the muffler comprising:

a housing forming a housing interior having an inlet chamber and an outlet chamber;

an exhaust inlet for receiving exhaust gas in the inlet chamber;

an exhaust outlet for directing exhaust gas from the outlet chamber;

a first channel within the housing interior to fluidly connect the inlet chamber and the outlet chamber, the first channel having a first noise dampening amount;

a second channel within the housing interior between the inlet chamber and the outlet chamber, the second channel having a second noise dampening amount, the first noise dampening amount being greater than the second noise dampening amount;

a valve within the housing interior configured to variably control a flow of exhaust gas through the first and second channels; and a controller operatively coupled with the valve and configured to control a position of the valve based on a signal corresponding to one of a plurality of selectable modes of operation, wherein the controller is configured to maintain the valve in one of a plurality of positions based on the selected mode, the plurality of positions including a partially open position.

2. The muffler as defined by claim 1, wherein the controller is within the housing interior.

3. The muffler as defined by claim 1, further comprising a motor within the housing interior, the motor being configured to move the position of the valve in response to a signal from the controller.

4. The muffler as defined by claim 1, wherein the valve is positioned within the first channel, the second channel, or both of the first and second channels, wherein the valve is configured to variably obstruct the flow of exhaust gas through a corresponding one of the first channel, second channel, or both of the first and second channels.

5. The muffler as defined by claim 1, wherein an exterior surface of the housing includes a top housing surface forming a recessed region.

6. The muffler as defined by claim 5, further comprising a motor positioned within the recessed region of the housing, the motor configured to move the position of the valve in response to a signal from the controller.

7. The muffler as defined by claim 6, wherein the motor includes a top motor surface that is substantially flush with or below the top housing surface.

8. The muffler as defined by claim 1, further comprising a third channel connecting the inlet chamber and the outlet chamber, the third channel having noise damping material.

9. The muffler as defined by claim 1 wherein the valve within the housing interior is configured to variably obstruct the flow of exhaust gas through the second channel.

10. The muffler as defined by claim 1, wherein the position of the valve as specified by the signal is based on dynamic parameters of the motorized vehicle.

11. The muffler as defined by claim 10, wherein the dynamic parameters include a throttle position of the motorized vehicle, a speed of the motorized vehicle, a load on an engine of the motorized vehicle, RPM of the engine, gear of a transmission system of the motorized vehicle, a position of the motorized vehicle in its environment, a local time, or any combination thereof.

12. A method of controlling the sound of a muffler system for a motorized vehicle, the method comprising:

flowing exhaust gas through a first channel inside a housing of a muffler, the first channel configured to dampen exhaust noise and connect an inlet chamber of the housing and an outlet chamber of the housing, a second channel being inside the housing between the inlet chamber and the outlet chamber and configured to selectively receive exhaust gas from the inlet chamber of the housing;

receiving, from a user interface outside of the housing, a signal corresponding to selectable mode of operation selected; and controlling, based on the received signal, a position of the valve within the housing by maintaining the valve in one of a plurality of positions, the plurality of positions including a partially open position, to vary flow of the exhaust gas through the first and second channels.

13. The method of claim 12, wherein controlling the position of the valve comprises:

determining, by a controller operatively coupled to the user interface, the position of the valve.

14. The method of claim 12, wherein controlling the position of the valve comprises:

operating a motor coupled to the valve to move the position of the valve.

15. The method of claim 12, wherein controlling the position of the valve comprises:

rotating a disk, positioned within the first channel, the second channel, or both of the first and second channels, about an axis.

16. The method of claim 12, wherein maintaining the position of the valve comprises:

determining the partially open position of the valve based on dynamic parameters of the motorized vehicle and the selected mode of operation.

17. The method of claim 16, wherein determining the position of the valve based on dynamic parameters of the motorized vehicle comprises:

determining the position of the valve based on a throttle position of the motorized vehicle, a speed of the motorized vehicle, a load on an engine of the motorized vehicle, RPM of the engine, gear of a transmission system of the motorized vehicle, a position of the motorized vehicle in its environment, a local time, or any combination thereof.

18. A muffler for a motorized vehicle, the muffler comprising:

a housing forming a housing interior having an inlet chamber;

an exhaust inlet for receiving exhaust gas in the inlet chamber;

a first exhaust outlet;

a second exhaust outlet;

a first channel within the housing interior fluidly connecting the inlet chamber with the first exhaust outlet, the first channel having noise damping material;

a second channel within the housing interior;

a valve within the housing interior configured to variably control the flow of exhaust gas through the first and second channels; and a controller operatively coupled with the valve and configured to control a position of the valve based on a signal, received from a user interface, corresponding to a selectable mode of operation, wherein the controller is configured to maintain the position of the valve in one of a plurality of positions based on the selected mode, the plurality of positions including a partially open position.

19. The muffler of claim 18 wherein the valve is within the second channel.

20. The muffler of claim 18 wherein the valve is outside of the second channel.

21. The muffler of claim 18, wherein the controller is within the housing interior.

22. The muffler as defined by claim 18, further comprising a motor within the housing interior, the motor being configured to move the position of the valve in response to a signal from the controller.

23. The muffler as defined by claim 18, wherein the valve is positioned within the first channel, the second channel, or both of the first and second channels, wherein the valve is configured to variably obstruct the flow of exhaust gas through a corresponding one of the first channel, the second channel, or both of the first and second channels.

24. The muffler as defined by claim 18, wherein an exterior surface of the housing includes a top housing surface forming a recessed region.

25. The muffler as defined by claim 24, further comprising a motor positioned within the recessed region of the housing, the motor configured to move the position of the valve in response to a signal from the controller.

26. The muffler as defined by claim 25, wherein the motor is positioned within the recessed region of the housing and includes a top motor surface that is substantially flush with or below the top housing surface.

27. The muffler as defined by claim 18, further comprising a third channel connecting the inlet chamber and the outlet chamber, the third channel having noise damping material.

28. The muffler as defined by claim 18, wherein the position of the valve is based on dynamic parameters of the motorized vehicle.

29. The muffler as defined by claim 28, wherein the dynamic parameters include a throttle position of the motorized vehicle, a speed of the motorized vehicle, a load on an engine of the motorized vehicle, RPM of the engine, gear of a transmission system of the motorized vehicle, a position of the motorized vehicle in its environment, a local time, or any combination thereof.

* * * * *